US008015624B2

(12) United States Patent
Baldackin et al.

(10) Patent No.: US 8,015,624 B2
(45) Date of Patent: Sep. 13, 2011

(54) HELMET SYSTEM

(76) Inventors: Mary-Ellen Baldackin, Parrysound (CA); Mike Bosley, Parrysound (CA)

( * ) Notice: Subject to any disclaimer, the term of this patent is extended or adjusted under 35 U.S.C. 154(b) by 317 days.

(21) Appl. No.: 12/432,828

(22) Filed: Apr. 30, 2009

(65) Prior Publication Data

US 2010/0275347 A1 Nov. 4, 2010

(51) Int. Cl.
*A42B 3/06* (2006.01)

(52) U.S. Cl. ..... 2/412; 2/425

(58) Field of Classification Search ..... 2/171.3, 2/410, 424, 422, 423, 6.6, 6.7, 415, 10, 5, 2/7

See application file for complete search history.

(56) References Cited

U.S. PATENT DOCUMENTS 5,093,936 A 3/1992 Copeland
5,517,691 A * 5/1996 Blake ..... 2/5
5,930,840 A 8/1999 Arai
6,032,297 A * 3/2000 Barthold et al. ..... 2/416
6,298,497 B1 10/2001 Chartrand
6,446,271 B1 9/2002 Ho
6,961,963 B2 * 11/2005 Rosie ..... 2/171.3
7,934,497 B1 * 5/2011 Grove et al. ..... 128/201.25
2005/0060793 A1 * 3/2005 Rosie ..... 2/424
2007/0056071 A1 * 3/2007 Smith ..... 2/5
2009/0199317 A1 * 8/2009 Schwiers et al. ..... 2/5
2011/0072548 A1 * 3/2011 Hersick et al. ..... 2/5

* cited by examiner

*Primary Examiner* — Danny Worrell
(74) *Attorney, Agent, or Firm* — Michael L. Greenberg, Esq.; Greenberg & Lieberman, LLC

(57) ABSTRACT

A helmet system that employs an outer shell and a unitary inner shell formed with compatible grooves and ridges respectively. The outer shell is formed with a switch. The outer shell and inner shell are further secured together via magnetic force or a system of springs and levers in conjunction with the switch that allows for a user of the helmet system to seamlessly remove the outer shell through either a set amount of breakaway force or by using the switch.

18 Claims, 4 Drawing Sheets

HELMET SYSTEM

FIELD OF THE PRESENT INVENTION

The present invention relates to a helmet system that employs an outer shell and an inner shell formed with compatible ridges and grooves. The outer shell and inner shell are further secured together via magnetic force or conventional levers and springs in conjunction with a switch that allows for a user of the helmet system to seamlessly remove the outer shell through either a set amount of breakaway force or by deactivating the switch.

BACKGROUND OF THE PRESENT INVENTION

Safety is paramount for many athletes playing in organized and unorganized sports. As such, protecting the head from injury is of prime importance. This is evident by the evolution of protective headgear. For example, the National Hockey League (NHL) did not officially require the use of helmets until the late 1970s. However, the first known professional player to wear a hockey helmet was George Owen in 1928. Hockey helmets among the professional ranks were considered in the 1930s after a helmetless "Ace" Bailey was forced to retire due to a head injury suffered during a game. In fact, the first professional hockey All-Star game was organized as a benefit to help support Bailey after the accident. Then in 1968, Minnesota player Bill Masterson, playing without a helmet, struck his head on the ice during a game against Oakland and ultimately died. This event caused numerous players to begin thinking about their physical safety in regard to head trauma. A few years later, lower levels of hockey began requiring helmets as the need became more pronounced. Today, the typical hockey helmet relates to a hard plastic shell that covers the cranial area of the head along with the ears. A chinstrap attached to the shell serves to lock the shell into a tight fit of the player.

Current helmets do serve as protection from errant pucks and crashing into the boards, other players or the ice. However, a problem has arisen when it comes to the removal of a helmet during the course of a game. For example, many fans and players of hockey consider fighting an integral part of the game. But the reality is that during such fights a player will remove his or her helmet. This makes it easier to participate in the fight but also carries significant risks. These risks were exacerbated recently when a 21-year old hockey player in Ontario removed his helmet to participate in a run-of-the-mill hockey fight. The player ended up striking the ice and ultimately died. Such realities have caused numerous hockey leagues, to include the NHL, to ban the removal of a hockey helmet. These rules have created an outcry and caused significant disdain from fans and players who claim that the spirit and integral portion of the game is being removed. To this end, there is a need for a helmet system that can protect a player's head during a game, but also be easily removable in a manner that still offers a less-invasive form of head protection.

In addition, such a need is not limited to hockey. For example, American football players throughout much of the sport's history merely wore leather helmets. However, these players now wear extensive head protection. At the same time, rugby players continue to wear older-style headgear. A problem often arises in these sports when the helmet flies off during a hard hit in the middle of a play. Once the helmet flies off, the play may still be active which means that the player may intentionally or inadvertently be involved in ongoing game activity without head protection. This is dangerous as players in such situations have been known to crash into the helmets/pads of other players in addition to the ground and even spikes from cleats as the player continues without the head protection. Because of this problem, there remains a need for a system of head protection that maintains a protective element for the head that offers close and continued protection even if the main bulk of the helmet is thrust off. In addition, this need also includes a stronger means of keeping a helmet secured to ones head during violent game situations.

The present invention solves these problems by forming an inner shell formed via relatively soft padding or foam that fits relatively tightly to the player's head. A chinstrap is secured to the inner shell. Meanwhile, an outer shell is interlocked to the inner shell. The outer shell is what spectators and other players will see and will essentially cover the inner shell. At least one groove in the outer shell and at least one ridge on the inner shell fit together as part of a securing mechanism.

Another need, particularly in regard to hockey, is the fact that helmets are removed very quickly during various situations to include fighting. The present invention satisfies this need in its preferred embodiment by placing a switch on the outer shell. This switch works in conjunction with the at least one groove and the at least one ridge as it utilizes ferromagnetic properties to force the outer shell and the inner shell together in an even closer and secure manner. In this way, the present invention makes it so that the only a certain amount of breakaway force or use of the switch will cause the outer shell and the inner shell to separate.

Because this need is so pronounced, particularly in regard to sports fans and commentators, the general idea of using an inner helmet and an outer shell is known. For example, a column on the BLEACHER REPORT Web site on Jan. 20, 2009 entitled "The Helmet: A Simple Solution to NHL Fighting," argued in support of such an idea to help keep fighting in NHL hockey while still offering protection. This article suggested that the chinstrap be attached to the inner helmet. However, articles, comments and other proposals relating to this at most describe a hard-cushioned back plate and an inner helmet designed along the lines of boxing headgear. Unlike the present invention, these ideas do not account for the stability of the outer shell and how the outer shell will interlock in a meaningful and tangible manner. The present invention responds to such important needs through its interlocking mechanisms and switch.

U.S. Pat. No. 5,930,840 issued to Arai on Feb. 26, 1997 is a pad for interior body of helmet and interior body thereof. Arai includes interior pads that wrap around the persons head via a band. Unlike the present invention, Arai does not account for the stability of an outer shell and how any outer shell associated with Arai will interlock in a meaningful and tangible manner. The same rationale can go toward U.S. Pat. No. 6,446,271 issued to Ho on Sep. 10, 2002 because Ho also uses pads for its internal aspect but does provide for an interlocking mechanism that is as effective as that of the present invention. The present invention is much different as it responds to such important needs through its interlocking mechanisms and switch.

U.S. Pat. No. 5,093,936 issued to Copeland et al on Mar. 10, 1992 is a protective headgear and detachable face protector. Copeland uses a rigid outer shell and an inner band of padding. Unlike the present invention, Copeland connects the inner band of padding to the rigid outer shell via a sizing harness that can be tightened or loosened via straps. Similar usage and concept relate to U.S. Pat. No. 6,298,497 issued to Chartrand on Oct. 9, 2001. Chartrand is a hockey helmet with self-adjusting pad. In contrast, the present invention uses the inner shell to thinly and lightly offer unitary protection to the head while engaging in the interlocking mechanism of the present invention to secure the inner shell to the outer shell.

While the idea of an internal helmet and external helmet exists, none solve the need for a system that allows a player to seamlessly remove an interlocked outer shell while maintaining the protection of the protective inner shell. The present invention satisfies this need by forming a unitary inner shell to cover the cranial areas of the head. In addition, the interlocking mechanisms of the present invention provide additional stability and security between the inner shell and the outer shell. This means that the player can better be in control of the helmet during fights or even during a hard and violent hit that otherwise might knock the helmet loose. As such, the present invention is a novel helmet system that offers increased protection while also engaging in a system of quick removal or interlocking between the inner shell and outer shell.

SUMMARY OF THE PRESENT INVENTION

The present invention is a helmet system relating to the formation and connection of an outer shell and an inner shell. The function of the present invention is such that users wearing the outer shell and inner shell in a hockey context can quickly and seamlessly remove the outer shell when engaged in a fight. This means that the softer inner shell will remain secured to the user's head for protection of both the user and the hands of a combatant. In addition, the outer shell based on the connection aspects of the present invention will remain secured to the inner shell in a manner that will maintain the stability and intended usefulness of the outer shell until a set or angled force or switch causes the outer shell to be removed.

The outer shell is formed via conventional means of hard outer material to protect the user's head. The interior of the outer shell is grooved or otherwise ridged so it can be interlocked with the inner shell. The inner shell is formed with complimentary ridges or grooves so that the inner shell and the outer shell can interlock. The inner shell is formed of conventional soft protective material such as foam. The inner shell directly touches the head of the user. It also should be noted that the system of the present invention places a chinstrap on the inner shell.

The preferred embodiment of the present invention places at least one magnetic strip on the outer shell and a compatible polarity magnetic strip on the inner shell. A switch or knob is formed into the outer shell and is connected to a track within the outer shell. The track is where the at least one magnetic strip is located. The switch is conventional and when activated by the user, the magnetic properties of the magnetic strip in the outer shell will be attracted to the magnetic properties of the magnetic strip in the inner shell. In the preferred embodiment, a breakway force is set via conventional means so that enough force of pulling the outer shell away from the inner shell will break the magnetic attraction, allowing the outer shell to be removed.

DETAILED DESCRIPTION OF THE PRESENT INVENTION

Figure 1:
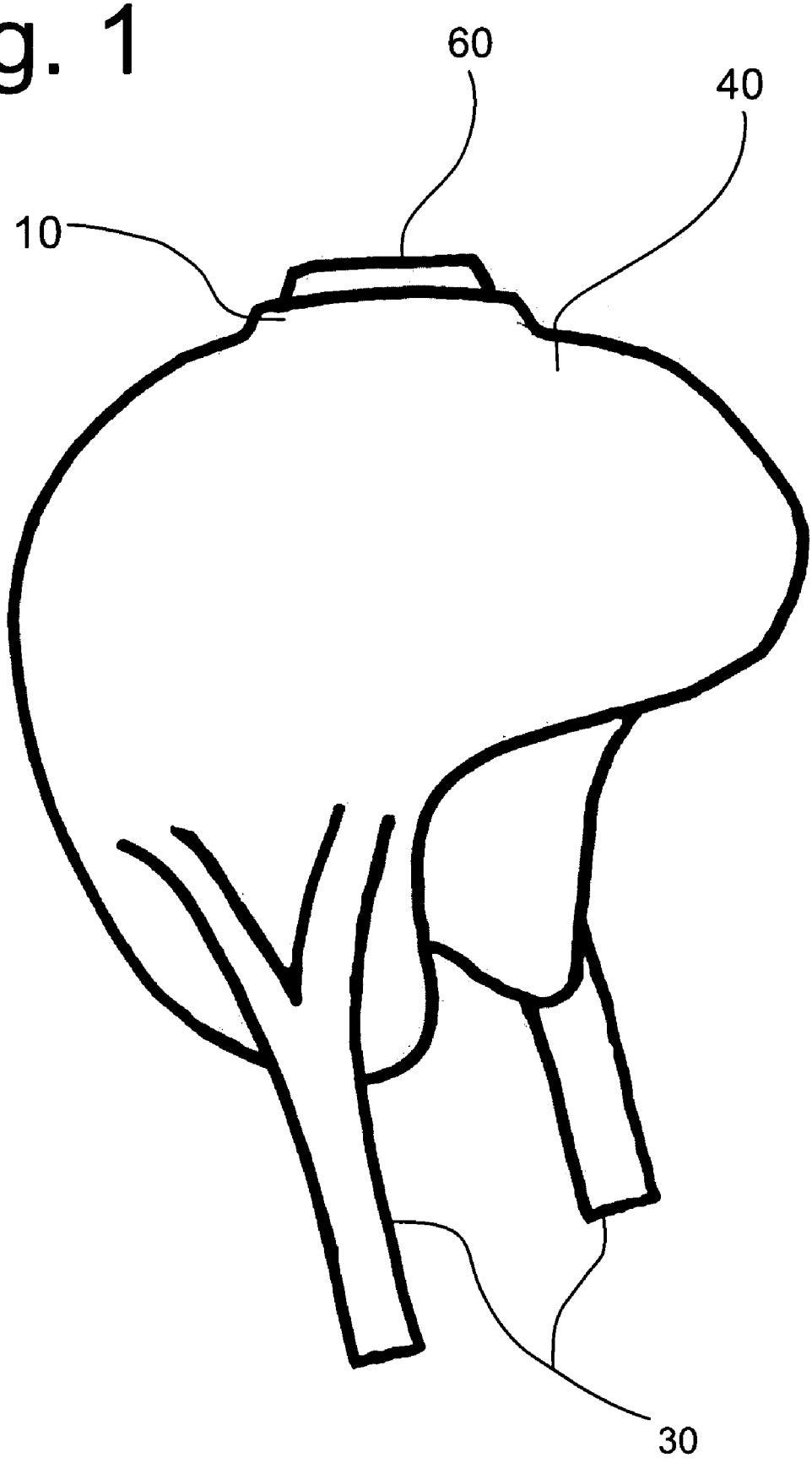
FIG. 1 is a view of an embodiment of the inner shell of the present invention

The present invention relates to an outer shell (20) and an inner shell (10) that interlock. FIG. 1 is a view of the inner shell (10) of the present invention. The present invention in the preferred embodiment envisions a system for hockey headgear due to its practical nature pertaining to that sport. In the example of hockey, a player can quickly actuate a switch (80) to release the interlocked outer shell (20) from the inner shell (10) and seamlessly remove the outer shell (20). In this way, the player can engage in fighting or any other activity while continuing to have the physical protection offered by the inner shell (10). However, the present invention can be used with virtually any type of helmet, particularly in sports such as biking, American football, rugby, lacrosse, equestrian, etc.

The inner shell (10) is formed of soft material such as foam and is unitary. The conventional material has a thickness to absorb direct blows derived from punches, the ground, boards, skates, shoes, other helmets, and errant projectiles such as balls or pucks that strike the inner shell (10). The inner shell (10) is formed to fit snuggly onto the head of a user. A conventional chinstrap (30) is attached to the inner shell (10) for additional balance and securing of the inner shell (10).

The top of the inner shell (10) has grooves or ridges in the preferred embodiment. At least one ridge (40) is seen in FIG. 1 that protrudes outward from the surface of the inner shell (10). The preferred embodiment places the at least one ridge (40) at strategic locations of the inner shell (10) such as the top, left and right sides. The at least one ridge (40) is configured to be inserted into at least one corresponding groove (50) that dips inward from the interior surface of the outer shell (20) at a depth and conventional makeup to permit a secure interlocking fit.

The inner shell (10) also is formed in the preferred embodiment with at least one inner magnetic strip (60). The at least one inner magnetic strip (60), also referred to as at least one lower magnet (60), is lined along the top surface of the inner shell (10). In an additional embodiment, the at least one inner magnetic strip (60) is secured to the at least one ridge (40) of the inner shell (10). The at least one lower magnet (60) is stationary in a fixed mounted position so that an upper magnet (70) comes to it.

Figure 2:
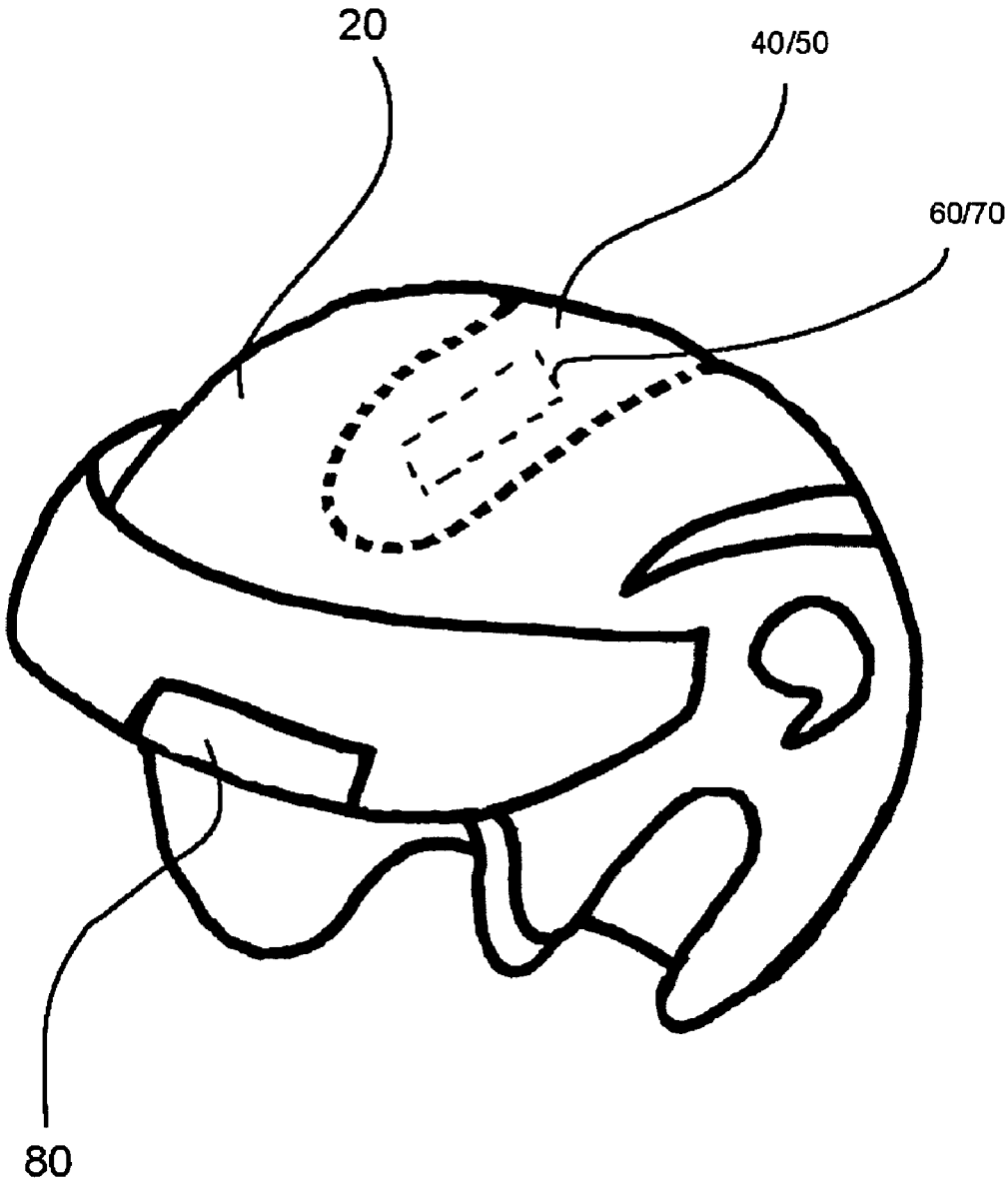
FIG. 2 is a view of an embodiment of the outer shell of the present invention

FIG. 2 depicts an embodiment of the outer shell (20). The outer shell (20) interlocks over the inner shell (10). FIG. 2 shows the example of an outer shell (20) to be used in hockey. However, it should be noted that the elements of the present invention can apply to other types of headgear and purposes as well.

The outer shell (20) is formed of hard material that conventionally is used for the respective sport or activity being used. The interior of the outer shell is formed to fit over and around the inner shell (10). At least one groove (50) is depressed inward into the interior of the outer shell (20). The at least one groove (50) is formed to correspond and receive the at least one ridge (40) protruding from the inner shell (10). It also should be noted that in an additional embodiment, the at least one groove (50) is formed from the inner shell (10) and the at least one ridge (40) is formed from the outer shell (20).

Once the at least one ridge (40) is fitted into the at least one groove (50), the at least one ridge (40) will be interlocked within the at least one groove (50). In the preferred embodiment, at least one outer shell magnetic strip (70), also referred to as at least one upper magnet (70) is lined within the interior of the outer shell (20). When activated, the at least one upper magnet (70) will be of such polarity via conventional means that it will attract and therefore lock with the corresponding at least one lower magnet (60). In the preferred embodiment, the at least one outer shell magnetic strip (70) is lined between a ferromagnetic track (90) that is surrounded by soft, protective material formed within the interior of the outer shell (20). The at least one upper magnet (70) is variable in that is can rotate within the ferromagnetic track (80). The at least one upper magnet (70) is formed with notches on the sides of the at least one upper magnet that communicate with at least one arm (100).

The at least one upper magnet (70) is in communication with a switch (80) via the at least one arm (100). The switch (80) in the preferred embodiment is a small knob located on an accessible outer portion of the outer shell (20). The switch (80) also may be a lever. The preferred embodiment places the switch (80) at the top of the outer shell (20), although the switch (80) also may be located in the back or on the sides of the outer shell (20). The switch (80), when turned by a user, moves the at least one arm (100). The at least one arm (100) is positioned via conventional means to be received in a downward motion by the notches of the at least one upper magnet (70). Turning the switch (80) therefore causes the at least one arm (100) to rotate the at least one magnet (70) to correspond with the movement of the switch (80). Once the poles of the at least one upper magnet (70) are parallel or close to being parallel to the opposite polarity poles of the at least one lower magnet (60), the at least one upper magnet (70) and the at least one lower magnet (60) will interlock.

The interlocking capability of the magnets can be deactivated by moving the switch (80). This process will ultimately move or rotate the at least one upper magnet (70) so that its polar attributes no longer attract with the polar attributes of the at least one lower magnet (60). In addition to the switch (80), breakaway force also can be used to remove the outer shell (20) from the inner shell (10). The size, makeup and other conventional properties of the at least one upper magnet (70) and at least one lower magnet (60) will determine the breakaway force needed to separate the magnets.

Figure 3:
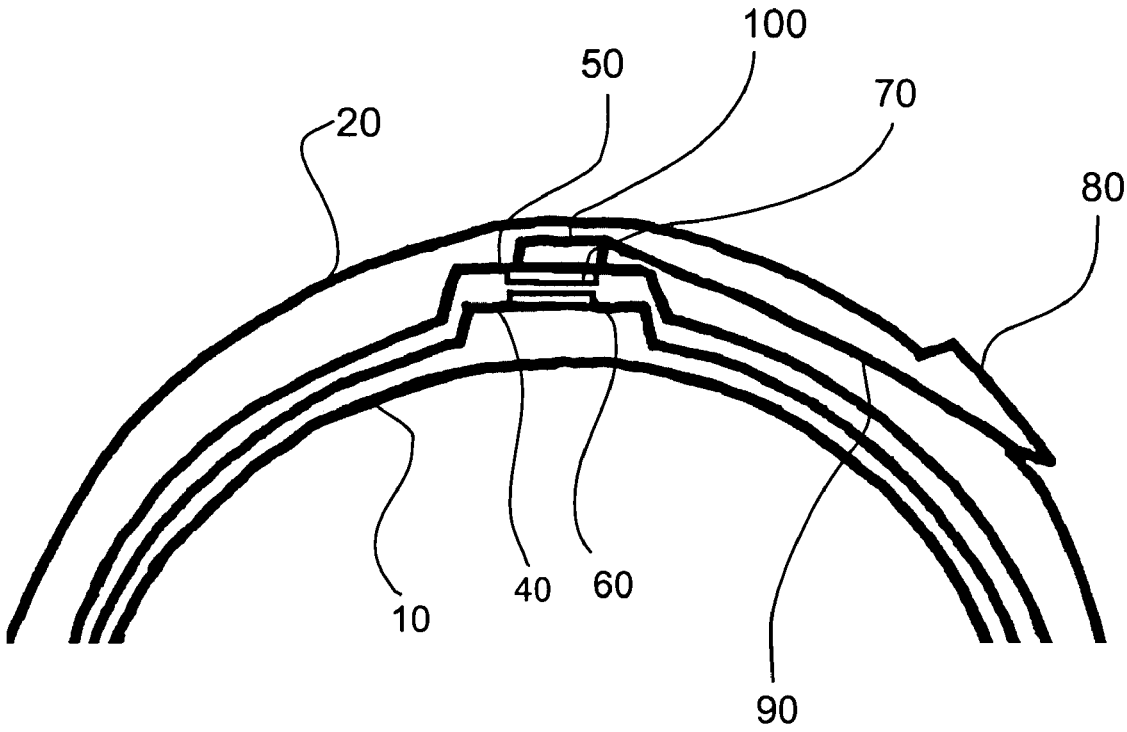
FIG. 3 is a view of the interlocking nature of the present invention

FIG. 3 presents a view of the present invention when the outer shell (20) is interlocked with the inner shell (10). As we see, the outer shell (20) is configured to fit over the inner shell (10). The inner shell (10) is configured to be worn or otherwise encompass the cranial area of a person's head. Once the at least one ridge (40) is placed into the at least one groove (50), the outer shell (20) and the inner shell (10) will be connected to each other. In the preferred embodiment, the switch (80) is located on the outer shell (20).

In an additional embodiment, the at least one groove (50) and the at least one ridge (40) are at such angles and formed in such a manner that the at least one ridge (40) can only be placed into the at least one groove (50) if inserted at a specific angle. For example, the at least one ridge (40) may only fit tightly into the at least one groove (50) at a 45-degree or 90-degree angle. In this regard, the outer shell (20) can only be removed from its connection with the inner shell (10) if the outer shell (20) is removed at the same 45-degree or 90-degree angle.

Figure 4:
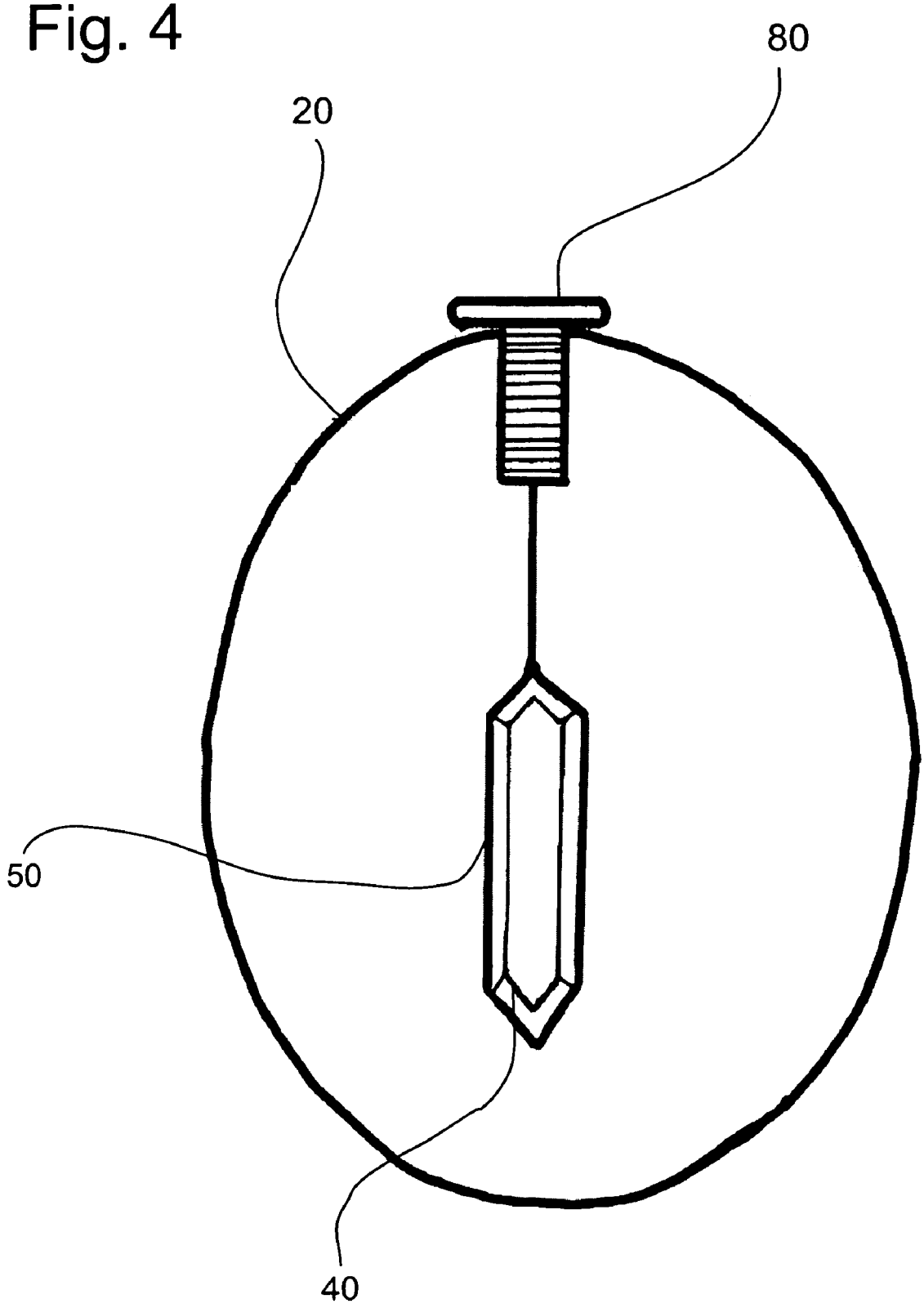
FIG. 4 is a view of an additional embodiment of the present invention

In an additional embodiment as seen in FIG. 4, the at least one groove (50) and the at least one ridge (40) are positioned in strategic locations along the inner shell (10) and outer shell (20) to include top, sides, front and rear areas of the outer shell (20) interior and inner shell (10) exterior respectively. Thin and pliable springs are in communication with the switch (80). The springs also are in communication with thin and pliable levers that are interwoven into either the at least one ridge (40) or the at least one groove (50). In this embodiment, the at least one ridge (40) is pushed into the at least one groove (50), which is slightly pliable and thinner than the at least one ridge (40) at its top, until the at least one ridge (40) is inserted and the at least one groove (50) snaps via conventional connection means via the force of the at least one ridge (40) insertion. The switch (80) when activated compresses the springs so that the levers slightly widen the at least one groove (50) at its top. This activation and widening movement will allow the at least one ridge (40) to be removed from the at least one groove (50) and consequently, the outer shell (20) can be released from the inner shell (10).

It also should be noted that an alternative version of this embodiment entails actuating the switch (80) before interconnecting the inner shell (10) and the outer shell (20). In this embodiment, the switch (80) will actuate the springs which in turn will widen the at least one groove (50) so that the at least one ridge (40) can be inserted. When the switch (80) is released, the springs and levers also release their hold on the at least one groove (50) so that it tightens and consequently locks around the at least one ridge (40).

This release aspect of the present invention in terms of the switch (80) also applies to the preferred embodiment relating to the at least one upper magnet (70) and at least one lower magnet (60). This means that once the switch is actuated, the interlocking connection between the outer shell (20) and the inner shell (10) will be released and/or connected either via embodiments featuring magnetic force or conventional snapping into place. In an additional embodiment, conventional connecting material such as VELCRO in relation to the outer shell and the inner shell also envisioned.

We claim:

1. A helmet system, comprising:

an outer shell configured to interlock to an inner shell and release from said inner shell;

said inner shell being unitary;

a chinstrap attached to said inner shell;

at least one ridge extending from the surface of said inner shell;

at least one groove dipping inward within the interior of said outer shell;

said at least one ridge configured to fit into said at least one groove;

an at least lower magnet lined along the at least one ridge;

said at least one lower magnet configured to be stationary in a fixed, mounted position;

said outer shell configured to fit over said inner shell;

an at least one upper magnet lined along the at least one groove;

said at least one upper magnet configured to be variable;

at least one arm in communication with said at least one upper magnet, said at least one arm being in communication with a switch;

said switch configured to move said at least one arm such that said at least one arm will move said at least one upper magnet so that said at least one upper magnet attracts via polarity and ferromagnetic force to said at least one lower magnet;

said switch configured to move said at least one arm such that said at least one arm will move said at least one upper magnet so that the attracting polarity of said at least one upper magnet rotates away from said at least one lower magnet; and said switch located on said outer shell.

2. The helmet system of claim 1, wherein said inner shell is configured to cover the cranial portion of a head.

3. The helmet system of claim 1, wherein said at least one upper magnet has notches on the sides of said at least one upper magnet.

4. The helmet system of claim 3, wherein said notches are configured to be in communication with said at least one arm.

5. A helmet system, comprising:

forming an inner shell to fit snuggly onto a head of a user, the inner shell being unitary;

attaching a chinstrap to the inner shell;

forming the inner shell such that at least one ridge protrudes outward;

forming an outer shell to fit over the inner shell, the outer shell having at least one groove depressed inward toward an interior of the outer shell;

locking the outer shell to the inner shell via forming the at least one groove to receive the at least one ridge in conjunction with a switch;

placing the switch on the outer shell; and placing the switch in communication with the outer shell such that when activated, the switch is configured to lock the outer shell to the inner shell and release the outer shell from the inner shell.

6. The helmet system of claim 5, further comprising securing an at least one lower magnet to the at least one ridge of the inner shell.

7. The helmet system of claim 6, further comprising mounting the at least one lower magnet onto the at least one ridge such that the at least one lower magnet is stationary.

8. The helmet system of claim 5, further comprising placing an at least one upper magnet within the at least one groove of the outer shell.

9. The helmet system of claim 8, further comprising lining the at least one upper magnet within a ferromagnetic track, the at least one upper magnet configured to be variable.

10. The helmet system of claim 9, further comprising forming the at least one upper magnet with notches.

11. The helmet system of claim 10, further comprising placing the notches in communication with at least one arm, the at least one arm in communication with the switch.

12. The helmet system of claim 5, further comprising rotating the at least one upper magnet by activating the switch.

13. The helmet system of claim 12, further comprising interlocking the outer shell with the inner shell when the at least one lower magnet receives the at least one upper magnet that has been rotated such that polarity of the at least one upper magnet is opposite of that of the at least one lower magnet.

14. The helmet system of claim 12, further releasing the outer shell from the inner shell when the at least one upper magnet is rotated via the switch such that polarity of the at least one upper magnet is similar to that of the at least one lower magnet.

15. The helmet system of claim 5, further comprising releasing the outer shell from the inner shell with an established amount of breakaway force related to set properties of an at least one upper magnet and an at least one lower magnet.

16. The helmet system of claim 5, further comprising placing springs into the outer shell such that the springs are in communication with the switch and levers.

17. The helmet system of claim 16, further comprising compressing the springs when the switch is activated causing the levers to move.

18. The helmet system of claim 17, further comprising widening the at least one groove when the switch is activated.

* * * * *